United States Patent [19]

Sweet

[11] Patent Number: 4,630,824

[45] Date of Patent: Dec. 23, 1986

[54] PLAYING CARD HOLDER

[76] Inventor: Richard F. Sweet, 1454 Briarglen Ave., Westlake Village, Calif. 91361

[21] Appl. No.: 795,933

[22] Filed: Nov. 7, 1985

[51] Int. Cl.[4] ..... A63F 1/10

[52] U.S. Cl. ..... 273/150; 40/124.4

[58] Field of Search ..... 273/148 A, 150; 40/124.2, 124.4

[56] References Cited

U.S. PATENT DOCUMENTS

| | | | |
|---|---|---|---|
| 711,103 | 10/1902 | Freeman | 273/150 |
| 1,286,780 | 12/1918 | Ribeyre | 273/150 |
| 1,344,547 | 6/1920 | Maier | 273/150 X |
| 1,416,447 | 5/1922 | Castles | 273/150 |
| 1,634,696 | 7/1927 | Teneau | 273/150 |
| 2,474,763 | 6/1949 | Thomas | 273/148 A X |
| 2,520,490 | 8/1950 | Boward | 273/150 |
| 2,564,315 | 8/1951 | Stark et al. | 273/150 |
| 2,665,916 | 1/1954 | Lakatos | 273/150 |
| 2,729,452 | 1/1956 | Baumann | 273/150 |
| 2,785,901 | 3/1957 | McLemore | 273/150 |
| 3,620,535 | 11/1971 | Cerney et al. | 273/150 |

FOREIGN PATENT DOCUMENTS

| | | | |
|---|---|---|---|
| 670675 | 8/1929 | France | 273/150 |
| 474455 | 9/1952 | Italy | 273/150 |

*Primary Examiner*—Anton O. Oechsle
*Attorney, Agent, or Firm*—Koppel & Harris

[57] ABSTRACT

A playing card holder is described in which two plates with diverging inner surfaces extend upward from a base section. The two plates diverge from each other within an angular range of about 1°–8°, and preferably about 3°–5°, to form a tapered slot within which the playing cards are inserted. The inner surface of each plate is lined with a layer of a flocked material, the layers being partially set into recesses in the opposed surfaces of each plate. The holder retains either a single card or a number of overlapping cards securely in place once they have been inserted into the slot, and yet permits cards to be easily removed without dislodging adjacent cards.

7 Claims, 6 Drawing Figures

PLAYING CARD HOLDER

BACKGROUND OF THE INVENTION

1. Field of the Invention

This invention relates to playing card holders, and more particularly to holders adapted to stand by themselves and to hold a number of overlapping playing cards at the same time.

2. Description of the Prior Art

Numerous attempts have been made to construct a self-standing playing card holder that can be used by either adults or children during a card game. An ideal playing card holder should be capable of easily accepting either single cards or a number of overlapping cards, of allowing one card to be pulled out of the holder without other cards unintentionally also being pulled out or dislodged, should display the cards so that they can be easily recognized and sorted by the user, and should be strong and durable in use. Unfortunately, no card holders are available which are known to satisfy all of these criteria. In addition, it would be desirable that the card holder simulate the action of a human hand as much as possible in holding cards. This would include features such as being able to hold the device comfortably in one's hand, being able to lay the cards face down without their falling out of the holder, and being able to set the holder upright either vertically or tilted back at an angle, all with a single unitary movement.

SUMMARY OF THE INVENTION

The object of the present invention is to provide a novel and improved playing card holder which satisfies all of the requirements stated above, and which is also simple in construction and easy to use.

The holder of the present invention includes a base from which first and second plates extend generally upward. The plates have opposed surfaces which diverge from each other away from the base to form a tapered slot within which playing cards are placed. The angular divergence of the plates is within the range of about 1°–8°, and preferably within about 3°–5°. The base includes a stand which is adapted to hold the device either vertically, or in a generally upright position at an angle tilted back from vertical.

In the preferred embodiment the opposed surfaces of the plates are each coated with a layer of flocked material. The plate surfaces include recesses of slightly lesser depths than the thicknesses of the flocked layers, allowing the flocked material to be disposed within the recesses but still contact the playing cards. The base forms an arcuate bottom stop for the slot that prevents cards from being inserted too far and maintains a uniform card height. The plates are formed from a stiffly resilient plastic material, and the holder is preferably manufactured in two sections which are joined to each other at the base.

Further features and advantages of the invention will be apparent to those skilled in the art from the following detailed description of preferred embodiments, taken together with the accompanying drawings, in which:

DETAILED DESCRIPTION OF PREFERRED EMBODIMENTS

Figure 1:
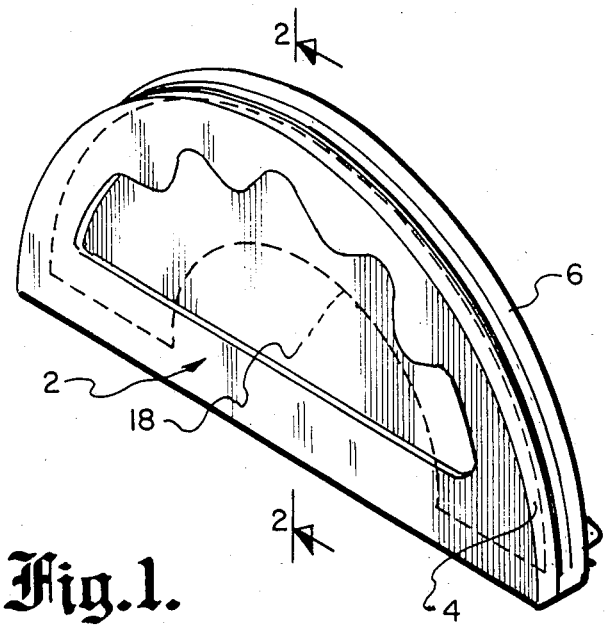
FIG. 1 is a perspective view of the playing card holder.

A perspective view of a playing card holder constructed in accordance with the present invention is provided in FIG. 1. The holder includes a lower base section 2 from which a pair of plates 4 and 6 extend generally upward. The stand is preferably made from a stiffly flexible plastic material such as PVC, polyethylene, nylon, polypropylene, styrene, etc. It is preferably formed with an arcuate upper surface so that playing cards may be evenly distributed around the upper portion of the stand.

Figure 2:
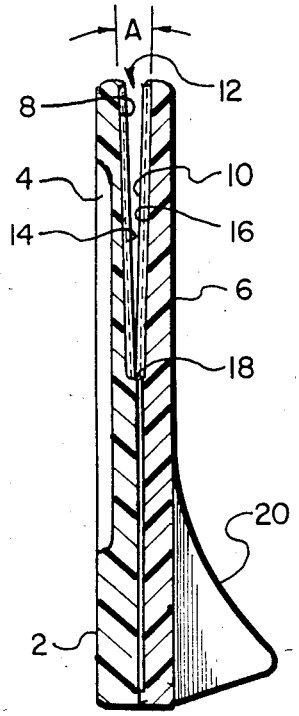
FIG. 2 is a sectional view taken along the lines 2—2 of FIG. 1.

As best shown in FIG. 2, the two plates 4 and 6 have mutually opposed inner surfaces 8 and 10 which diverge away from each other with increasing distance from the base section 2. The two plates thus form a tapered slot 12 within which playing cards may be secured. The angle of divergence A between the two plates is within the approximate range of 1°–8°, and preferably is about 3°–5°. It is not essential that the plates maintain a constant angle of divergence throughout their lengths, but this is preferred. The plates 4 and 6 include arcuate recesses in their inner surfaces, indicated by dashed lines in FIG. 1 for plate 4, within which respective layers 14, 16 of a flocked material are partially disposed. The thicknesses of the flocked material layers are preferably somewhat greater than the depths of their respective recesses, so that the flocked materials extend slightly beyond the inner surfaces of the plates to contact the playing cards. Various types of flocked material may be used so long as their surfaces produce sufficient static friction to securely hold the playing cards in place, but display a dynamic friction low enough to enable easy insertion and removal of the cards. Examples of suitable materials are felt and Rubbermaid Contact Brand Cushion-All Flocked Covering Material. The latter is a stick-on material which is provided with a removable paper backing and is approximately 0.022 inch (0.559 mm) thick after the backing has been removed.

The plates come into near or total contact with each other at the bottoms of their respective recesses. The lower end of recess 8 is extended to depth to form a lip 18 which abuts against plate 6 at the lower end of recess 10 to provide a stop for slot 12 along the arcuate path indicated in FIG. 1. Viewed another way, stop 18 coincides with the upper end of base 2. The bottom of the base is squared off, allowing the card holder to be stood up vertically during play. The base also includes a pair of legs 20 which extend out from one side to form a stand for supporting the card holder in a generally upright position. The legs are spaced widely apart so that the card holder can be hand-held without interference from the legs. The underside of legs 20 extend up from horizontal by an angle of approximately 18°, thus permitting the card holder to be tilted back at an approximately 18° angle to vertical when in use. This provides better visibility of the cards for a player seated at a normal card table.

Figure 3:
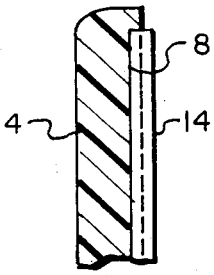
FIG. 3 is an enlarged fragmentary sectional view showing a layer of flocked material for contacting the playing cards recessed in the holder.

An enlarged view of the upper portion of plate 4 is shown in FIG. 3. It can be seen that the recess begins slightly below the top of the plate, and is shallower than the thickness of flocked material 14. The recess is deep enough to prevent the flocked material from extending out from the plate so far as to interfere with the insertion of cards into the holder, but is shallow enough to ensure that the playing cards make a good surface contact with the flocked material.

The playing card holder described thus far is preferably manufactured in two molded sections, each section including a respective one of the plates and a portion of the base. Various arrangements may be used to hold the sections securely together at the base. For example, the holder can be made from plastics such as polypropylene and polyethylene with snaps provided along the lower portion of one section and mated with sockets in the other section. Alternatively, the holder could be formed from certain types of plastics such as polystyrene which can be chemically or ultrasonically bonded together.

Figure 4:
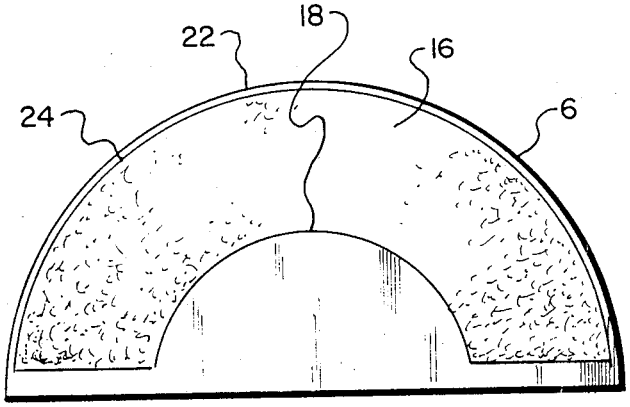
FIG. 4 is an elevational view of the inner face of one of the plates which form the holder base.

Referring now to FIG. 4, the inner face of section 6 is shown; the inner face of section 4 is substantially identical. The upper outer periphery 22 of the section, the upper edge 24 of the recess which holds the flocked material and the stop 18 which forms the lower edge of the recess all describe mutually concentric arcs. This results in a protrusion of all the cards in the holder a substantially uniform distance above the holder.

Figure 5:
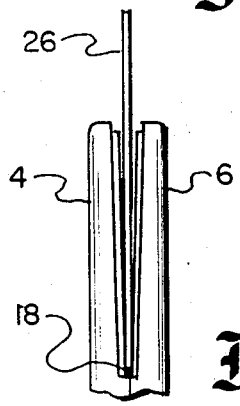
FIGS. 5 and 6 are enlarged fragmentary sectional views of the playing card holder respectively showing a relatively small and a relatively large number of playing cards held in the device.
Figure 6:
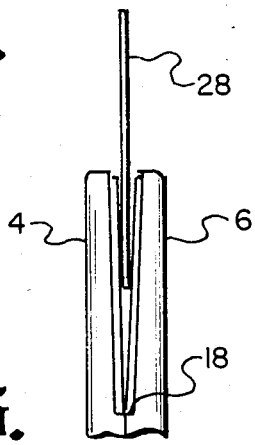

A relatively small number of cards 26 are illustrated as being secured by the holder in FIG. 5. Since the opposed pieces of flocked material are slightly separated at their lower end, the cards bottom out against stop 18. It is a distinct advantage of the invention that it will accommodate a considerably larger number of cards and still hold them with a uniform protrusion above the holder. This is important for games in which the players must be able to hold numerous cards, such as contract bridge, crazy eights and old maid. FIG. 6 illustrates how the holder accommodates a relatively large number of cards 28. Since the thickness of the cards taken together is greater than the spacing between the opposed sections at bottom stop 18, the cards are inserted only partially into the slot. Due to the taper of the slot, the cards can be inserted to a depth above stop 18 at which they are securely held in place, and still extend above the holder by approximately equal amounts.

In operation, the playing card holder is set upright and cards are inserted into the slot 12 between the two plates. It has been found that, with the combination of tapered plates and the flocked inner surface material, either one or a number of overlapping cards will be securely held in place, and yet can be easily removed. It is a distinct advantage of this construction that, when one card is removed, adjacent cards tend to stay in place and are not pulled out along with the moving card. The holder also allows cards to be pulled out, reinserted and rearranged continually without disrupting the other cards or substantially disturbing the uniform card height above the holder.

Numerous modifications and alternate embodiments of the invention will occur to those skilled in the art. Also, while the invention has been described in terms of a playing card holder, it is equally capable of holding slips of paper, note cards and the like. Accordingly, it is intended that the invention be limited only in terms of the following claims:

I claim:

1. A holder for playing cards, comprising:

a base, first and second generally arcuate plates formed from a stiff material extending generally upward from the base, the plates having opposed surfaces which mutually diverge from each other away from the base to form a tapered slot of substantially permanent dimensions and having an angular divergence within the approximate range of about 1°–8°, said slot having a generally arcuate bottom stop which is generally concentric with the plates, said plates being spaced apart from each other to releasably secure playing cards placed in the slot by the opposed lateral pressures of the plates against the cards with no substantial movement of the plates, the slot dimensions being adapted to accommodate the penetration of a small number of cards to a location near the stop, and of larger number of cards to locations further removed from the stop, the spacing between the plates being sufficiently small to hold cards placed throughout the slot against lateral slippage, and means for holding the base in a generally upright position.

2. The playing card holder of claim 1, wbherein the opposed surfaces of said plates mutually diverge from each other with an angular divergence within the approximate range of about 3°–5°.

3. The playing card holder of claim 1, wherein the opposed surfaces of said plates are each substantially coated with respective layers of a flocked material.

4. The playing card holder of claim 3, the opposed surfaces of said plates including recesses of lesser depths than the thicknesses of said layers of flocked material, the flocked material being disposed in said recesses.

5. The playing card holder of claim 3, said base including a stand for supporting the card holder in a generally upright position at a non-zero angle to vertical.

6. The playing card holder of claim 5, the bottom of the holder being squared to enable the holder to be stood up substantially vertically.

7. The playing card holder of claim 1, said holder being formed from two members, each member including a respective portion of the base and a respective plate extending therefrom, said base portions being joined together with their respective plates mutually diverging as described.

* * * * *